US006974534B2

(12) United States Patent
Stubergh

(10) Patent No.: US 6,974,534 B2
(45) Date of Patent: Dec. 13, 2005

(54) PROCESS FOR PREPARING SILICON AND OPTIONALLY ALUMINUM AND SILUMIN (ALUMINUM-SILICON ALLOY)

(75) Inventor: Jan Reidar Stubergh, Moss (NO)

(73) Assignee: Norwegian Silicon Refinery AS, Moss (NO)

( * ) Notice: Subject to any disclaimer, the term of this patent is extended or adjusted under 35 U.S.C. 154(b) by 188 days.

(21) Appl. No.: 10/469,050

(22) PCT Filed: Feb. 21, 2002

(86) PCT No.: PCT/NO02/00075

§ 371 (c)(1),
(2), (4) Date: Nov. 5, 2003

(87) PCT Pub. No.: WO02/077325

PCT Pub. Date: Oct. 3, 2002

(65) Prior Publication Data

US 2004/0108218 A1 Jun. 10, 2004

(30) Foreign Application Priority Data

Feb. 26, 2001 (NO) ..... 20010963

(51) Int. Cl.[7] ..... C25B 1/00; C25C 3/06
(52) U.S. Cl. ..... 205/410; 205/358; 205/364; 205/372
(58) Field of Search ..... 205/410, 358, 205/364, 372

(56) References Cited

U.S. PATENT DOCUMENTS 3,405,043 A 10/1968 Barakat et al.
4,292,145 A * 9/1981 De Mattei et al. ..... 205/410
5,873,993 A * 2/1999 Stubergh ..... 205/364

FOREIGN PATENT DOCUMENTS

WO 9533870 12/1995
WO 97/27143 7/1997

* cited by examiner

*Primary Examiner*—Arun S. Phasge
(74) *Attorney, Agent, or Firm*—Wenderoth, Lind & Ponack, L.L.P.

(57) ABSTRACT

Process for preparing highly purified silicon and optionally aluminum and silumin (aluminum silicon alloy) in the same cell, wherein silicate and/or quartz containing rocks are subjected to electrolysis in a salt melt containing fluoride, whereby silicon and aluminum are formed in the same bath, and aluminum formed, which may be low alloyed, flow to the bottom and is optionally drawn off, and deposit formed on the cathode is removed from the cathode and crushed, optionally together with the remaining electrolysis bath, concentrated sulfuric acid and then hydrochloric acid and water are added to the crushed material, liberated Si-grains float to the surface and are taken out and treated further as desired.

16 Claims, No Drawings

PROCESS FOR PREPARING SILICON AND OPTIONALLY ALUMINUM AND SILUMIN (ALUMINUM-SILICON ALLOY)

This application is a 371 of PCT/NO02/00075 filed Feb. 21, 2002.

The present invention relates to a process for preparing silicon and optionally aluminum and silumin (aluminum silicon alloy) in a salt melt by electrolysis and subsequent refining of the silicon. Silica and silicate rocks and/or aluminum containing silicate rocks are used as raw material, with/without soda ($Na_2CO_3$) and/or limestone ($CaCO_3$) dissolved in fluorides, in particular cryolite.

The products prepared are of high purity.

WO 95/33870 (EP patent 763151), in the following designated as "WO 95", discloses a process for continuous preparation and batch preparation in one or more steps in one or more furnaces, of silicon (Si), optionally silumin (AlSi-alloys) and/or aluminum metal (Al) in a melting bath using feldspar or feldspar containing rocks dissolved in fluoride. In said process Si of high purity is prepared by electrolysis (step I) in a first furnace with a replaceable carbon anode arranged underneath the cathode, and a carbon cathode arranged at the top of the furnace. For the preparation of silumin the silicon-reduced residual electrolyte from step I is transferred to another furnace, and Al is added (step II). Then Al is prepared in a third furnace (step III) by electrolysis after Si has been removed in step I and possibly in step II. It also describes combinations of furnaces with a partition wall in the preparation of the same substances. Further, process equipment for the procedure is described.

The present invention represents a further development and improvement of the above-mentioned process. The greatest improvement is that it is possible to prepare pure Si, pure low-iron low-alloyed Al-alloys (AlSi-alloys) and pure low-phosphorus high-alloyed Al-alloys (SiAl-alloys) in the same furnace (step I) by varying such parameters as the choice of raw material, current density (voltage) and time. The proportions of the Si and Al-products are adjusted by the choice of raw material and cathodic current density (voltage) in the electrolysis bath and mechanical manipulation of the cathodes. Further, the composition of the Al-products varies with the electrolysis time (examples 1–5).

A low-alloyed Al-alloy (AlSi-alloy) as referred to herein, is an Al-alloy with an amount of Si which is lower than that of an eutectic mixture (12% Si, 88% Al). Correspondingly, a high-alloyed Al-alloy (SiAl-alloy) as referred to herein is an alloy having a Si-content above that of an eutectic mixture.

According to the present invention there is provided a process for preparing highly purified silicon and optionally aluminum and silumin (aluminum silicon alloy) in the same cell. The process takes place by I. subjecting silicate and/or quartz containing rocks to electrolysis in a fluoride containing salt melt, whereby silicon and aluminum are formed in the same bath, and aluminum formed, which may be low alloyed, flows downwards to the bottom and is optionally drawn off, and II. deposit formed on the cathode of the electrolysis furnace is removed from the cathode and crushed, optionally together with the remaining electrolysis bath, and is treated with concentrated sulfuric acid and then hydrochloric acid and water, and liberated Si-grains float to the surface and are taken out and treated further as desired.

Soda is added to the electrolysis bath so that said bath will be basic if quartz is used, in order to avoid loss of Si in the form of volatile $SiF_4$. With high concentrations of soda the melting point of the mixture is reduced, and the use of added fluorides goes down. Limestone is added if necessary to reduce the absorption of phophorus in the Si deposited on the cathode.

In connection with the further treatment (refining) of the Si-product, the fluorides in the salt melt should preferably be acidic. The acidic fluorides, which are formed by adding sulfuric acid to cryolite (step II), have been analyzed and contain a mixture of cryolite ($Na_3AlF_6$) and aluminum fluoride ($AlF_3$). Possibly the mixture may be added externally and stirred into molten silicon.

EXAMPLE 1 (from WO 95)

A feldspar of the type $CaAl_2Si_2O_8$ containing 50% $SiO_2$, 31% $Al_2O_3$ and 0.8% $Fe_2O_3$, was dissolved in cryolite and electrolyzed with a cathodic current density of 0.05 A/cm$^2$ (U=2.5–3.0 V) for 18.5 hours. In the deposit around the cathode highly purified Si was formed separate from small FeSi-grains. In the electrolyte dissolved $Al_2O_3$ was formed. Al is not formed.

Since Al was not formed in the bath ($Al^{3+}$-containing electrolyte) this was the reason why bath was drawn off from this furnace (step I) and to another furnace (step II) in which residues of Si and Si(IV) were removed by addition of Al before the electrolysis and the preparation of Al in a third furnace (step III). (See WO 95).

Conclusion: The reason why only Si and not Al was formed in step I in the present case, was the low current density (voltage).

EXAMPLE 2

A feldspar of the type $NaAlSi_3O_8$, containing 68% $SiO_2$, 20% $Al_2O_3$ and 0.07% $Fe_2O_3$, was dissolved in cryolite and electrolyzed with a cathodic current density of 0.5 A/cm$^2$ (U=6.5–8.0 V) for 3 hours. In the deposit around the cathode highly purified Si and a few small FeSi-grains were formed. Underneath the electrolyte Al (low-alloyed AlSi-alloy) was formed, and this had low iron content.

Conclusion: The reason why both Si and Al were formed in step I was the high current density (voltage).

EXAMPLE 3

A diorite (rock) containing feldspar and quartz, analyzed to contain 72% $SiO_2$, 16% $Al_2O_3$ and 1.4% $Fe_2O_3$, was dissolved in cryolite and electrolyzed at a cathodic current density of 0.5–1.6 A/cm$^2$ (U=2.5–8.0 V) for 16.5 hours. In the deposit around the cathode highly purified Si and many small separate FeSi-grains were formed. Underneath the electrolyte Al (low-alloyed AlSi-alloy) was formed, and this had a low iron content.

Conclusion: The reason why both Si and Al were formed in step I was the high current density (voltage). The reason why the Al (AlSi-alloy) has low iron content, is that the FeSi-grains remain in the deposit on the cathode.

EXAMPLE 4

A feldspar containing rock of the type $KAlSi_3O_8$, containing 65% $SiO_2$, 18% $Al_2O_3$ and 0.3% $Fe_2O_3$, was dissolved in cryolite and electrolyzed at a cathodic current density of 0.5 A/cm$^2$ (U=3–4.0 V) for 13 hours. In the deposit around the cathode highly purified Si and small FeSi-grains were formed. Some of the deposit was pushed down into the bath (the electrolyte). While the cathode deposit contained 20% Si, the bath (the electrolyte) contained 3% Si after the final electrolysis. Underneath the electrolyte Al (low-alloyed AlSi-alloy) was formed, and this still had a low content of iron.

Conclusion: The reason why both Si and Al were formed in step I is the high current density (voltage). The reason why the Al (the AlSi-alloy) still had a low content of iron, was that the FeSi-grains had not had sufficient time to seep out of the viscous cathode deposit and into Al before the bath was frozen.

EXAMPLE 5

Quartz containing close to 99.9% $SiO_2$ was dissolved in cryolite ($Na_3AlF_6$), mixed with 5% soda ($Na_2CO_3$) and electrolyzed with a cathodic current density of 0.5 A/cm$^2$ (U=6–7 V) for 44 hours. In the deposit around the cathode highly purified Si was formed. Most of (12 kg) of the cathode deposit was pushed into the bath (the electrolyte). The remaining cathode deposit (8 kg) was lifted out with the cathodes together with the residues of the anode. The cathode deposit was easily knocked off the cathodes and was mixed with the electrolyte in the bath. Both contained 20% Si. Small amounts of Al (low alloyed AlSi-alloy) were formed, which were low in iron and phosphorus. Iron and phosphorus poor AlSi-alloys are defined as <130 ppm Fe and <8 ppm P. The analysis of Al showed 8% Si and 110 ppm Fe and 0.08 ppm P.

Conclusion: The reason why both Si and Al were formed in step I was the high current density (voltage). Al originates from electrolyzed cryolite. The reason why Al (the AlSi-alloy) was now alloyed with Si, was that Si from the cathode deposit starts to dissolved in Al. The reason why the Al-alloy is iron and phophorus poor is that the raw materials initially are low in iron and phophorus.

The above examples 1–5 illustrate step I of the present process.

The silicon together with residues of small grains of FeSi prepared by acid refining (step II), contains a total of 75 ppm Fe and about 15 ppm P. The concentrated Si powder mixture contained 80% Si or more. In a further treatment in the form of crystal rectification of the silicon after step II a distribution coefficient (segregation coefficient) of 0.35 for phosphorus is expected. This means that when the Si powder contained 15 ppm P it is expected that crystal rectified Si should contain about 6 ppm P. In addition it was found that the crystallization of Si was not perfect. From this one could conclude that the P-content should have been higher than 6 ppm. The analysis showed that the P-content in Si was 1.0 ppm. The reason why the P-content is so low is found to be the mixing of slag with the fluorides, which takes place with good stirring of the Si melt with slag. The silicon contained 3 ppm contaminations or 99.9997% Si.

If it is desired to prepare Al together with Si, the cathodic current density should be relatively high, at least above 0.05 A/cm$^2$, preferably above 0.1, in particular above 0.2 A/cm$^2$. An upper limit is about 2, preferably about 1.6 A/cm$^2$. In addition to the formation of aluminum with a high current density, the electrolysis rate also increases with increasing cathodic current density.

In all the described examples it was found that the purity of Si was in the range 99.92–99.99%. Previously (WO 95) in order to concentrate Si further above 20% from the cathode deposit, the cathode deposit was crushed so that as much as possible of free and partly not free Si-grains would float up and could be taken up on the surface in a heavy liquid consisting of different $C_2H_2Br_4$/acetone mixtures with a density of up to 2.96 g/cm$^3$. Si in solid form has a density of 2.3 g/cm$^3$ and will float up, while solids of cryolite have a density of 3 g/cm$^3$ and will remain at a bottom. After filtration and drying of the powder for removal of heavy liquid, the different concentration fractions were mixed with water/$H_2SO_4$/HCl for refining Si.

In WO 97/27143, in the following designated as "WO 97", water, HCl and $H_2SO_4$ in this order were added to crushed cathode deposit, containing 20% Si, to refine Si with a dilute NaOH which was formed by adding water. Then it was tried to concentrate the powder containing Si refined with HCl, with concentrated $H_2SO_4$.

Neither in WO 95 nor in WO 97 was Si concentrated more than to about 40%. The reason for this is that the fluorooxo-silicate complexes in the cathode deposit were hydrolyzed in water and NaOH to form a difficultly soluble hydrated silica. As a consequence of this an addition of $H_2SO_4$ after the treatment with water did not accomplish the concentration effect which it has when added directly to untreated dry powder. Concentrated HCl does not have any essential concentrating effect as it contains much water in contrast to concentrated $H_2SO_4$. In WO 97 a jig was used to concentrate Si further. This resulted only in an insignificant concentration.

When it is primarily desired to prepare Si, a quartz containing rock is suitably used as starting material. If Al is also of interest, a rock containing an Al-rich feldspar, for instance anorthite ($CaAl_2Si_2O_8$) is suitably used.

A new and essential feature of the invention is that concentrated $H_2SO_4$ is added to the untreated, pulverized cathode deposit containing 20% Si, or the pulverized bath (electrolyte) containing 20% Si, or mixtures of these. The powder fractions initially result in a concentration of Si to about 50% as the sulfuric acid has a good dissolving effect on cryolite. This mixture of 50% Si and other residual products, i.a. acidic sulfates, represents a sticky substance which must be treated further. By diluting the mixture with water and adding HCl in dilute amounts for some time a very good liberation of Si-grains floating to the surface is achieved. The HCl addition has the effect in addition to the refining of Si, that the powder mixture does not remain sticky. In this manner it is possible to obtain a concentration of Si of 80% or more than 80% in a Si/electrolyte grain mixture with a sand-water consistency. This sand-water consistency has the effect that the mixture is easy to filter and is washed with water and dried at room temperature. As a consequence of the concentration of Si to 80% in the powder mixture the use of jig as a separator (WO 97) becomes superfluous. What happens is that the acidic mixture gradually reacts with the electrolyte and dissolves it. The Si-grains which are partly embedded in electrolyte, are gradually liberated and get in contact with the acid/water mixture. The acidic water attacks the contaminations in Si, which primarily consist of metals. Hydrogen gas is formed on the surface and in the pores of the Si-grains, which results in an uplift even in very dilute acid. In addition to the fact that Si (d=2.3 g/cm$^3$) floats up to the surface of the water, the Si-grains will be hanging there until they are scraped away from the surface. The refining of the Si-grains has also been improved in addition to the concentration, since the acids over a longer time get in better contact with the liberated Si-grains. (The Si-grains are so pure that one gets below the detection limit for all the elements analyzed with microprobe equipment. This means that there is not any analysis method which can determine Si purer than about 99.99% as long it is impossible to concentrate Si to ~100% from a Si/electrolyte grain mixture).

Si may be melted together with Al prepared in the electrolysis (step I), to form Fe-poor, P-poor, low alloyed AlSi-alloys and/or high alloyed SiAl-alloys, which are desired alloys in may connections.

Both the high alloyed SiAl-alloys and the low-alloyed AlSi-alloys may be dissolved in HCl or $H_2SO_4$. Al goes into solution and "pure"-Si-powder (~100% and free from electrolyte) is formed. From dissolved Al pure products of $AlCl_3$ and $Al_2(SO_4)_3$ are formed.

To further concentrate and refine Si from the Si/electrolyte mixture after step II, traditional melting and casting methods for Si are chosen. It has been found that the remaining fluoride containing slag products which are now less than 20% of the remaining powder mixture (Si and electrolyte) has a refining effect on the remaining contaminations in the Si-powder during the melting, by mixing well (stirring together) the Si-powder and residual electrolyte after they have melted, so that solidified Si in this case is purer than if fluoride containing slag had not been present.

With respect to equipment it is suitable that the walls consisting of graphite in the electrolysis furnace advantageously can be replaced by SiC or silicon nitride-bound SiC. The walls of the electrolysis furnace do not have to consist of Si (WO 95, FIG. 2 number 4). Further, Si does not have to cover the anode stem, since a current jump does not take place between the cathode and anode even when they grow together.

What is claimed is:

1. A process for preparing highly purified silicon and optionally aluminum and silumin (aluminum silicon alloy) in the same cell, wherein I. silicate and/or quartz containing rocks are subjected to electrolysis in a salt melt containing fluoride, whereby silicon and aluminum are formed in the same bath, and aluminum formed, which may be low alloyed, flow to the bottom and is optionally drawn off, and II. deposit formed on the cathode is removed from the cathode and crushed, optionally together with the remaining electrolysis bath, concentrated sulfuric acid and then hydrochloric acid and water are added to the crushed material, liberated Si-grains float to the surface and are taken out and treated further as desired.

2. The process according to claim 1, wherein the fluoride-containing electrolysis bath contains cryolite.

3. The process according to claim 2, wherein soda ($Na_2CO_3$) and limestone ($CaCO_3$) are used in the electrolysis bath.

4. The process according to claim 2, wherein quartz containing rocks are used as starting material for the preparation of Si.

5. The process according to claim 2, wherein a rock containing aluminum rich feldspar ($CaAl_2Si_2O_8$) is used for the preparation of both aluminum and silicon.

6. The process according to claim 2, wherein further treatment takes place by mixing a basic, neutral or acidic fluoride-containing electrolyte into the molten silicon; slag and silicon are separated; and the silicon is crystallized.

7. The process according to claim 1, wherein soda ($Na_2CO_3$) and limestone ($CaCO_3$) are used in the electrolysis bath.

8. The process according to claim 7, wherein quartz containing rocks are used as starting material for the preparation of Si.

9. The process according to claim 7, wherein a rock containing aluminum rich feldspar ($CaAl_2Si_2O_8$) is used for the preparation of both aluminum and silicon.

10. The process according to claim 7, wherein further treatment takes place by mixing a basic, neutral or acidic fluoride-containing electrolyte into the molten silicon; slag and silicon are separated; and the silicon is crystallized.

11. The process according to claim 1, wherein quartz containing rocks are used as starting material for the preparation of Si.

12. The process according to claim 11, wherein further treatment takes place by mixing a basic, neutral or acidic fluoride-containing electrolyte into the molten silicon; slag and silicon are separated; and the silicon is crystallized.

13. The process according to claim 1, wherein a rock containing aluminum rich feldspar ($CaAl_2Si_2O_8$) is used for the preparation of both aluminum and silicon.

14. The process according to claim 13, wherein further treatment takes place by mixing a basic, neutral or acidic fluoride-containing electrolyte into the molten silicon; slag and silicon are separated; and the silicon is crystallized.

15. The process according to claim 1, wherein further treatment takes place by mixing a basic, neutral or acidic fluoride-containing electrolyte into the molten silicon; slag and silicon are separated; and the silicon is crystallized.

16. The process according to claim 15, wherein the fluoride-containing electrolyte is the acidic fluoride-containing electrolyte.

* * * * *